US010651546B2

(12) United States Patent
Deng

(10) Patent No.: US 10,651,546 B2
(45) Date of Patent: May 12, 2020

(54) MULTI-BEAM ANTENNAS HAVING LENSES FORMED OF A LIGHTWEIGHT DIELECTRIC MATERIAL

(71) Applicant: CommScope Technologies LLC, Hickory, NC (US)

(72) Inventor: Gangyi Deng, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/777,344

(22) PCT Filed: Jan. 18, 2017

(86) PCT No.: PCT/US2017/013845

§ 371 (c)(1),
(2) Date: May 18, 2018

(87) PCT Pub. No.: WO2017/127378

PCT Pub. Date: Jul. 27, 2017

(65) Prior Publication Data

US 2018/0337442 A1 Nov. 22, 2018

Related U.S. Application Data

(60) Provisional application No. 62/280,271, filed on Jan. 19, 2016.

(51) Int. Cl.
*H01Q 1/24* (2006.01)
*H01Q 25/00* (2006.01)
(Continued)

(52) U.S. Cl.
CPC ..... *H01Q 1/246* (2013.01); *H01Q 1/36* (2013.01); *H01Q 5/30* (2015.01); *H01Q 15/10* (2013.01);
(Continued)

(58) Field of Classification Search
CPC ..... H01Q 1/246; H01Q 1/36; H01Q 19/09; H01Q 21/0087; H01Q 25/008;
(Continued)

(56) References Cited

U.S. PATENT DOCUMENTS 3,243,483 A 3/1966 Marshall
3,366,965 A 1/1968 Ochiai
(Continued)

FOREIGN PATENT DOCUMENTS

CN 1444621 9/2003
EP 0309982 9/1990
(Continued)

OTHER PUBLICATIONS

Extended European Search Report for corresponding European Application No. 1774.1820.9, dated Jul. 19, 2019, 8 pgs.
(Continued)

*Primary Examiner* — Hai V Tran
(74) *Attorney, Agent, or Firm* — Myers Bigel, P.A.

(57) ABSTRACT

A multi-beam antenna includes a plurality of radiating elements and a lens that is positioned to receive electromagnetic radiation from at least one of the radiating elements, the lens comprising a composite dielectric material. The composite dielectric material comprises a foamed base dielectric material having particles of a high dielectric constant material embedded therein, the high dielectric constant material having a dielectric constant that is at least three times a dielectric constant of the foamed base dielectric material.

18 Claims, 7 Drawing Sheets

(51) Int. Cl.

| | |
|---|---|
| ***H01Q 21/00*** | (2006.01) |
| ***H01Q 1/36*** | (2006.01) |
| ***H01Q 19/09*** | (2006.01) |
| ***H01Q 19/06*** | (2006.01) |
| ***H01Q 5/30*** | (2015.01) |
| ***H01Q 15/10*** | (2006.01) |
| ***H01Q 21/26*** | (2006.01) |
| ***H01Q 21/24*** | (2006.01) |

(52) U.S. Cl.
CPC ..... *H01Q 19/062* (2013.01); *H01Q 19/09* (2013.01); *H01Q 21/00* (2013.01); *H01Q 21/0087* (2013.01); *H01Q 21/24* (2013.01); *H01Q 21/26* (2013.01); *H01Q 25/00* (2013.01); *H01Q 25/001* (2013.01); *H01Q 25/008* (2013.01)

(58) Field of Classification Search
CPC ..... H01Q 15/02; H01Q 1/48; H01Q 25/001; H01Q 19/062; H01Q 5/30; H01Q 15/10; H01Q 21/26; H01Q 21/00; H01Q 1/24; H01Q 25/00
USPC ..... 343/753
See application file for complete search history.

(56) References Cited

U.S. PATENT DOCUMENTS

| | | | | |
|---|---|---|---|---|
| 4,613,784 | A | 9/1986 | Haun et al. | |
| 5,154,973 | A * | 10/1992 | Imagawa | H01Q 15/08 428/325 |
| 6,562,448 | B1 | 5/2003 | Chamberlain et al. | |
| 6,781,487 | B2 | 8/2004 | Hattori et al. | |
| 7,068,898 | B2 | 6/2006 | Buretea et al. | |
| 7,113,146 | B2 | 9/2006 | Pearlman et al. | |
| 7,235,502 | B2 | 6/2007 | Kalpat et al. | |
| 7,268,637 | B2 | 9/2007 | Aisenbrey | |
| 7,317,420 | B2 | 1/2008 | Aisenbrey | |
| 7,365,395 | B2 | 4/2008 | Stumbo et al. | |
| 7,592,957 | B2 | 9/2009 | Achour et al. | |
| 8,089,152 | B2 | 1/2012 | Miller | |
| 8,134,511 | B2 | 3/2012 | Koh et al. | |
| 8,271,241 | B2 | 9/2012 | Akyurtlu et al. | |
| 8,378,877 | B2 | 2/2013 | Tishin et al. | |
| 8,518,537 | B2 | 8/2013 | Matitsine | |
| 8,558,311 | B2 | 10/2013 | Dubrow et al. | |
| 9,728,860 | B2 | 8/2017 | Matitsine et al. | |
| 9,819,094 | B2 | 11/2017 | Matitsine et al. | |
| 2001/0029119 | A1 | 10/2001 | Chung | |
| 2004/0029985 | A1 * | 2/2004 | Aki | C08J 9/0066 521/99 |
| 2004/0104847 | A1 | 6/2004 | Killen et al. | |
| 2006/0165971 | A1 * | 7/2006 | Kuroda | B29O 44/445 428/317.9 |
| 2008/0278394 | A1 | 11/2008 | Koh et al. | |
| 2010/0026607 | A1 * | 2/2010 | Imai | G01S 7/03 343/911 R |
| 2011/0003131 | A1 | 1/2011 | Matitsine | |
| 2011/0205119 | A1 | 8/2011 | Timofeev et al. | |
| 2015/0002352 | A1 * | 1/2015 | Merlet | H01Q 13/06 343/753 |
| 2015/0042526 | A1 | 2/2015 | Zeine | |
| 2015/0091767 | A1 | 4/2015 | Matitsine et al. | |
| 2015/0325348 | A1 | 11/2015 | Matitsine | |
| 2017/0062944 | A1 * | 3/2017 | Zimmerman | H01Q 15/02 |

FOREIGN PATENT DOCUMENTS

| | | |
|---|---|---|
| GB | 665747 | 1/1952 |
| GB | 1125828 | 9/1968 |
| JP | 53-026996 | 3/1978 |
| JP | 2001-316514 | 11/2001 |
| WO | 02102584 | 12/2002 |
| WO | 2005002841 | 1/2005 |
| WO | 2007/083921 | 7/2007 |

OTHER PUBLICATIONS

International Search Report and Written Opinion of the International Searching Authority, International Application No. PCT/US2017/013845, dated Apr. 28, 2017, 13 pp.
Chinese Office Action for corresponding Chinese Application No. 201780004981.9, dated Dec. 30, 2019, 19 pages.

* cited by examiner

MULTI-BEAM ANTENNAS HAVING LENSES FORMED OF A LIGHTWEIGHT DIELECTRIC MATERIAL

CROSS-REFERENCE TO RELATED APPLICATION APPLICATIONS

This application is a 35 U.S.C. § 371 national stage application of PCT Application Serial No. PCT/US2017/013845, filed on Jan. 18, 2017, which itself claims priority from and the benefit of U.S. Provisional Patent Application No. 62/280,271, filed Jan. 19, 2016, the disclosures of both of which are hereby incorporated herein in their entireties. The above-referenced PCT Application was published in the English language as International Publication No. WO 2017/127378 A1 on July 27, 2017.

BACKGROUND

The present invention generally relates to radio communications and, more particularly, to lensed multi-beam antennas utilized in cellular communications systems.

Cellular communications systems are well known in the art. In a cellular communications system, a geographic area is divided into a series of regions that are referred to as "cells," and each cell is served by a base station. The base station may include one or more antennas that are configured to provide two-way radio frequency ("RF") communications with mobile subscribers that are geographically positioned within the cells served by the base station. In many cases, each base station provides service to multiple "sectors," and each of a plurality of antennas will provide coverage for a respective one of the sectors. Typically, the sector antennas are mounted on a tower or other raised structure, with the radiation beam(s) that are generated by each antenna directed outwardly to serve the respective sector.

A common wireless communications network plan involves a base station serving three hexagonal shaped cells using three base station antennas. This is often referred to as a three sector configuration. In a three sector configuration, each base station antenna serves a 120° sector. Typically, a 65° azimuth Half Power Beamwidth (HPBW) antenna provides coverage for a 120° sector. Three of these 120° sectors provide 360° coverage. Other sectorization schemes may also be employed. For example, six, nine, and twelve sector configurations are also used. Six sector sites may involve six directional base station antennas, each having a 33° azimuth HPBW antenna serving a 60° sector. In other proposed solutions, a single, multi-column array may be driven by a feed network to produce two or more beams from a single phased array antenna. For example, if multi-column array antennas are used that each generate two beams, then only three antennas may be required for a six sector configuration. Antennas that generate multiple beams are disclosed, for example, in U.S. Patent Publication No. 2011/0205119, which is incorporated herein by reference.

Increasing the number of sectors increases system capacity because each antenna can service a smaller area and therefore provide higher antenna gain throughout the sector. However, dividing a coverage area into smaller sectors has drawbacks because antennas covering narrow sectors generally have more radiating elements that are spaced wider apart than are the radiating elements of antennas covering wider sectors. For example, a typical 33° azimuth HPBW antenna is generally twice as wide as a typical 65° azimuth HPBW antenna. Thus, cost, space and tower loading requirements increase as a cell is divided into a greater number of sectors.

SUMMARY

As a first aspect, embodiments of the invention are directed to a multi-beam antenna, comprising a plurality of radiating elements and a lens that is positioned to receive electromagnetic radiation from at least one of the radiating elements, the lens comprising a composite dielectric material. The composite dielectric material comprises a foamed base dielectric material having particles of a high dielectric constant material embedded therein, the high dielectric constant material having a dielectric constant that is at least three times a dielectric constant of the foamed base dielectric material.

As a second aspect, embodiments of the invention are directed to a multi-beam antenna, comprising a plurality of radiating elements and a lens that is positioned to receive electromagnetic radiation from at least one of the radiating elements, the lens comprising a plurality of blocks that are contained within an outer shell of a composite dielectric material. Each block comprises a composite dielectric material that includes a base dielectric material having particles of a high dielectric constant material embedded therein, the high dielectric constant material having a dielectric constant that is at least three times a dielectric constant of the base dielectric material.

As a third aspect, embodiments of the invention are directed to a method of fabricating a multi-beam antenna, the method comprising: mixing particles of a second dielectric material into a first dielectric material that is in liquid form, the second dielectric material having a dielectric constant that is at least three times a dielectric constant of the first dielectric material; adding a nucleating agent to the first dielectric material; using a blowing agent to foam the first dielectric material having the particles of the second dielectric material mixed therein; using the foamed first dielectric material for a lens for the multi-beam antenna; and mounting the lens in front of at least one radiating element.

DETAILED DESCRIPTION

Figure 1A:
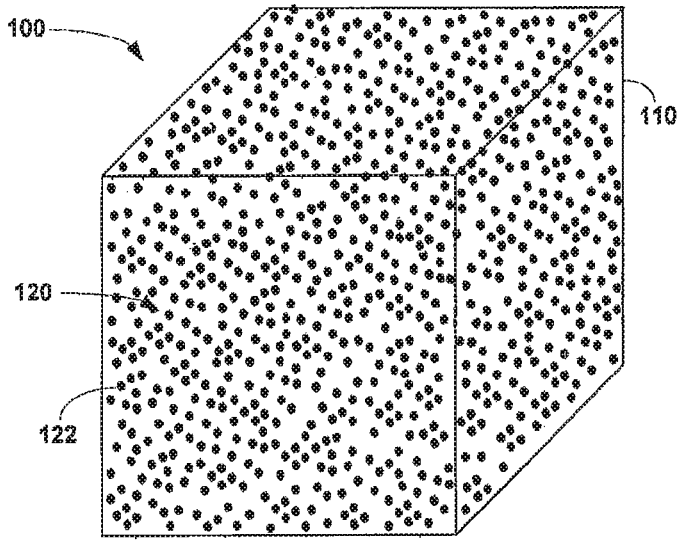
FIG. 1A is a schematic perspective view of a composite dielectric material according to embodiments of the present invention that is suitable for use in fabricating a lens for an antenna.

Antennas have been developed that have multi-beam beam forming networks that drive a planar array of radiating elements, such as a Butler matrix. Multi-beam beam forming networks, however, have several potential disadvantages, including non-symmetrical beams and problems associated with port-to-port isolation, gain loss, and/or a narrow bandwidth. Multi-beam antennas have also been proposed that use Luneberg lenses, which are multi-layer cylindrical lenses that have dielectric materials having different dielectric constants in each layer. Unfortunately, the costs of Luneberg lenses is prohibitively high for many applications, and antenna systems that use Luneberg lenses may still have problems in terms of beam width stability over a wide frequency band and/or high cross-polarization levels.

U.S. Patent Publication No. 2015/0091767 ("the '767 publication") proposes a multi-beam antenna that has linear arrays of radiating elements and a cylindrical RF lens that is formed of a dielectric material. The RF lens is used to focus the azimuth beams of the linear arrays. In an example embodiment, the 3 dB beam width of a linear array may be reduced from 65° without the lens to 23° with the lens. The entire contents of the '767 publication are incorporated herein by reference.

The lens disclosed in the 767 publication differs from a conventional Luneberg lens in that the dielectric constant of the material used to form the lens may be the same throughout the lens, in contrast with the Luneberg lens design in which multiple layers of dielectric material are provided where each layer has a different dielectric constant. A cylindrical lens having such a homogenous dielectric constant may be easier and less expensive to manufacture, and may also be more compact, having 20-30% less diameter. The lenses of the 767 publication may be made of small blocks of dielectric material. The dielectric material focuses the RF energy that radiates from, and is received by, the linear arrays. The '767 publication teaches that the dielectric material may be an artificial dielectric material of the type described in U.S. Pat. No. 8,518,537 ("the '537 patent"), the entire contents of which is incorporated herein by reference. In one example embodiment, small blocks of the dielectric material are provided, each of which includes at least one needle-like conductive fiber embedded therein. The small blocks may be formed into a much larger structure using an adhesive that glues the blocks together. The blocks may have a random orientation within the larger structure. The dielectric material used to form the blocks may be a lightweight material having a density in the range of, for example, 0.005 to 0.1 g/cm$^3$. By varying the number and/or orientation of the conductive fiber(s) that are included inside the small blocks, the dielectric constant of the material can be varied from 1 to 3.

Unfortunately, the dielectric material used in the lens of the '767 publication may be expensive to manufacture. Moreover, because the dielectric material includes conductive fibers, it may be a source of passive intermodulation distortion that can degrade the quality of the communications. Additionally, the conductive fibers included in adjacent small blocks of material may become electrically connected to each other resulting in larger particle sizes that can negatively impact the performance of the lens.

Pursuant to embodiments of the present invention lensed multi-beam antennas are provided that include lenses formed of a lightweight, low-loss composite dielectric material. The imaginary part of the complex representation of the permittivity of a dielectric material is related to the rate at which energy is absorbed by the material. The absorbed energy reflects the "loss" of the dielectric material, since absorbed energy is not radiated. Low-loss dielectric materials are desirable for use in lenses for antennas as it is desirable to reduce or minimize the amount of RF energy that is lost in transmitting the signal through the lens.

A number of low loss dielectric materials are known in the art such as, for example, solid blocks of polystyrene, expanded polystyrene, polyethylene, polypropylene, expanded polypropylene and the like. Unfortunately, these materials may be relatively heavy in weight and/or may not have an appropriate dielectric constant. For some applications, such as lenses for base station antennas, it may be important that the dielectric material be a very low weight material.

The multi-beam lensed antennas according to embodiments of the present invention may have lenses that are formed of a composite dielectric material that comprises a mixture of a high dielectric constant material and a low dielectric constant base dielectric material that exhibits a suitable dielectric constant and that is very light weight. By foaming the base dielectric material, a very lightweight matrix can be constructed that the higher dielectric constant material may be embedded into. In some embodiments, the composite dielectric material may comprise a large block of foamed plastic or other foamed base dielectric material that includes particles (e.g., a powder) of a high dielectric constant material embedded therein. In some embodiments, the high dielectric constant material may be a non-conductive material such as, for example, a ceramic or a non-conductive oxide. The particles of high dielectric constant material may have a variety of different shapes and may be distributed throughout the foamed lightweight base dielectric material. In some embodiments, the composite dielectric material may comprise a plurality of small blocks of a base dielectric material, where each block has particles of a high dielectric constant dielectric material embedded therein. The small blocks may be adhered together using, for example, an adhesive such as rubber adhesives or adhesives consisting of polyurethane, epoxy or the like, which have low dielectric losses.

Embodiments of the present invention will now be discussed in further detail with reference to the drawings, in which example embodiments are shown.

FIG. 1A is a schematic perspective view of a composite dielectric material 100 according to embodiments of the present invention that is suitable for use in fabricating a lens for a multi-beam antenna. As shown in FIG. 1A, the composite dielectric material 100 comprises a lightweight base dielectric material 110 that has a plurality of particles 122 of a high dielectric constant material 120 embedded therein. The base dielectric material 110 may have a low dielectric constant. The base dielectric material 110 may comprise, for example, a plastic material such as polyethylene, polystyrene, polytetrafluoroethylene (PTEF), polypropylene, polyurethane silicon or the like.

The base dielectric material 110 may comprise a foamed material having a very low density. In some embodiments, base dielectric material 110 may be foamed so that in the composite dielectric material 100 the ratio between the dielectric base material 100 and the foaming gas (e.g., air) is less than 50% by volume (i.e., a foaming percentage that exceeds 50%). The base dielectric material 110 may be foamed, for example, by injecting a gas such as air into the base dielectric material 110 while the base dielectric material 110 is in a liquid form. During the foaming process, a nucleating agent may be included in the liquid base dielectric material 100 that facilitates the foaming process. For example, an agent that reduces the surface tension of the liquid base dielectric material 110 may be added to the base dielectric material 110. In some embodiments, the foaming percentage of the base dielectric material 110 may exceed 70% or may even exceed 80%. Such high foaming percentages may facilitate reducing the weight of the composite dielectric material 100 and hence the weight of any lens formed thereof. In some embodiments, the base dielectric material 110 may be foamed in such a way to provide an open-cell foamed material comprising thin films of solid material separating regions or "pockets" of gas (e.g., air) that may connect to each other. While closed-cell foamed composite dielectric materials (i.e., a foam in which the gas forms discrete pockets, each completely surrounded by the solid material) may be used in other embodiments, these materials may tend to require more base dielectric material and hence may be heavier and more expensive to produce.

The high dielectric constant material 120 may comprise, for example, small particles 122 of a non-conductive material such as, for example, a ceramic or a metal oxide. Example ceramic materials that may be used include $Mg_2TiO_4$, $MgTiO_3$, $CaTiO_3$, $BaTi_4O_9$, boron nitride and the like. Example non-conductive (or low conductivity) oxides include titanium oxide, aluminium oxide and the like. The high dielectric constant material 120 may preferably have a relatively high ratio of dielectric constant to weight, and also is preferably relatively inexpensive and readily incorporated into the lightweight base dielectric material 110. The high dielectric constant material 120 may comprise a powder of very fine particles 122 in some embodiments. In some embodiments, the particles 122 of high dielectric constant material 120 may have generally spherical shapes. In other embodiments, the particles 122 may have random shapes, In still other embodiments, the particles 122 may have other shapes such as elongated shapes (e.g., cylinders or rectangular cubes having an aspect ratio of at least two or, in some embodiments, of at least five).

The density of the composite dielectric material 100 can be, for example, between 0.005 to 0.1 g/cm$^3$ in some embodiments. The particles 122 of high dielectric constant material 120 may be generally uniformly distributed throughout the base dielectric material 110. Individual particles 122 may be randomly oriented within the base dielectric material 110. The amount of high dielectric constant material 120 that is included in the composite dielectric material 100 may be selected so that the composite dielectric material 100 has a dielectric constant within a desired range. In some embodiments, the dielectric constant of the composite dielectric material 100 may be in the range of, for example, 1 to 3.

In FIG. 1A, the composite dielectric material 100 is formed into the shape of a cube. It will be appreciated that the composite dielectric material 100 may have any appropriate shape. As will be discussed in detail herein, in some embodiments, the composite dielectric material 100 may have the shape of a cylinder or of a sphere, or variants thereof It will also be appreciated that the composite dielectric material 100 may be manufactured to have a first shape and then be cut, ground, machined or otherwise shaped into a desired shape, or may be directly manufactured to have the desired shape.

Figure 1B:
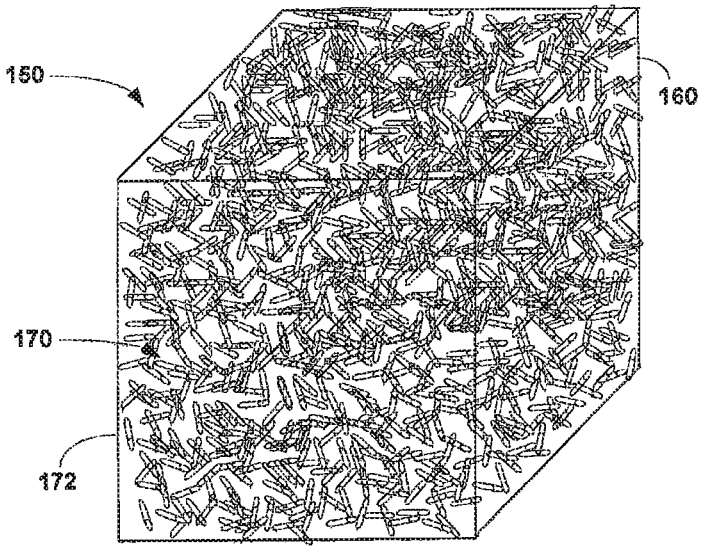
FIG. 1B is a schematic perspective view of a composite dielectric material according to further embodiments of the present invention that is suitable for use in fabricating a lens for an antenna.

FIG. 1B is a schematic perspective view of a composite dielectric material 150 according to further embodiments of the present invention. The composite dielectric material 150 may also be suitable for use in fabricating a lens for a multi-beam antenna.

As shown in FIG. 1B, the composite dielectric material 150 comprises a base dielectric material 160 that has a plurality of particles 172 of a high dielectric constant material 170 embedded therein. The base dielectric material 160 may be the same as the base dielectric material 110 that is discussed above, and hence further description thereof will be omitted. The base dielectric material 160 may comprise a foamed material having a very low density.

The high dielectric constant material 170 may also comprise, for example, a ceramic material, although non-ceramic materials may also be used. The high dielectric constant material 170 differs from the high dielectric constant material 120 in that it comprises elongated particles 172. The elongated particles 172 may be uniformly distributed and randomly oriented throughout the base dielectric material 160. The amount of high dielectric constant material 170 that is included in the composite dielectric material 150 may be selected so that the composite dielectric material 150 has a dielectric constant within a desired range. The composite dielectric material 150 may be manufactured in a desired shape or formed into a desired shape after manufacture.

Figure 2:
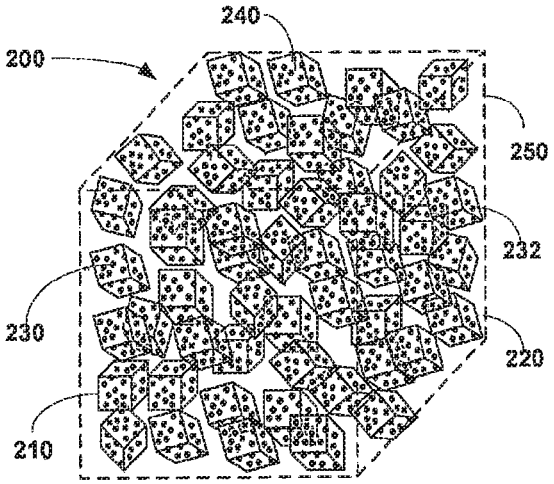
FIG. 2 is a schematic perspective view of a composite dielectric material according to additional embodiments of the present invention that is suitable for use in fabricating a lens for an antenna.

FIG. 2 is a schematic perspective view of a composite dielectric material 200 according to additional embodiments of the present invention that is suitable for use in fabricating a lens for a multi-beam antenna. As shown in FIG. 2, the composite dielectric material 200 comprises a plurality of small dielectric blocks 210 that are adhered together using an adhesive 240. The adhesive 240 may, for example, be coated on the surface of the blocks 210. The blocks 210 may optionally be contained within an outer shell 250 (which is shown using dashed lines in FIG. 2), in which case the adhesive 240 may or may not be omitted.

Each block 210 may comprise a base dielectric material 220 that has a plurality of particles 232 of a high dielectric constant material 230 embedded therein. The base dielectric material 220 may comprise, for example, a foamed plastic material such as foamed (or "expanded") polyethylene, polystyrene, polytetrafluoroethylene (PTEF), polypropylene, polyurethane silicon or the like. The high dielectric constant material 230 may comprise, for example, small particles of a high dielectric constant ceramic material. Each block 210 may comprise, for example, a small cube (or other shaped block) that is formed of the composite dielectric material 100 that is discussed above with reference to FIG. 1A.

In an example embodiment, each block 210 may be cube-shaped with each side of the cube having a length between 0.5 and 3.0 mm. The high dielectric constant material 230 may comprise particles 232 having diameters (assuming that the particles are generally circular in shape) that are much smaller than the length of sides of the cubes 210, such as diameters of 0.2 mm or less in some embodiments.

While the blocks 210 that are depicted in FIG. 2 include generally spherical particles 232 of the high dielectric constant material 230, it will be appreciated that in other embodiments, the blocks 210 may include particles 232 of a high dielectric constant material 230 that have different shapes. For example, elongated particles such as the particles 172 that are included in the composite dielectric material 150 may be used as the high dielectric constant material 230. In some embodiments, these elongated particles may be randomly distributed throughout the base dielectric material 220 included in each block 210. In other embodiments, the particles 232 may be elongated particles that are formed in arrays of two or more particles in each dielectric block 210 in the same manner that conductive fibers are formed in arrays within particles in the above-referenced '537 patent. In other embodiments, the particles 232 may comprise a finely ground powder of the high dielectric constant material 230.

As noted above, in some embodiments, the blocks 210 may be contained within an outer shell 250 such as a shell formed of a dielectric material that is shaped in the desired shape for the lens for a base station antenna. In such embodiments, the adhesive 240 may or may not be used to adhere the blocks 210 together. Base station antennas may be subject to vibration or other movement as a result of wind, rain, earthquakes and other environmental factors. Such movement can cause settling of the blocks 210, particularly if an adhesive 240 is not used and/or if some blocks 210 are not sufficiently adhered to other blocks 210 and/or if the adhesive 240 loses adhesion strength over time and/or due to temperature cycling. In some embodiments, the shell 250 may include a plurality of individual compartments (not shown) and the small blocks 210 may be filled into these individual compartments to reduce the effects of settling of the blocks 210. The use of such compartments may increase the long term physical stability and performance of a lens that is formed using the blocks 210. It will also be appreciated that the blocks 210 may also and/or alternatively be stabilized with slight compression and/or a backfill material. Different techniques may be applied to different compartments, or all compartments may be stabilized using the same technique.

While in the embodiment of FIG. 2 the particles 232 of high dielectric constant material 230 are shown embedded throughout the base dielectric material 220, it will be appreciated that in other embodiments the particles 232 may only be embedded in and/or otherwise adhered to the exterior surfaces of the blocks 210. In such embodiments, the blocks 210 may have a smaller volume to ensure that the particles 232 of high dielectric constant material 230 are distributed fairly uniformly throughout the composite dielectric material 200.

The above-described composite dielectric materials 100, 150, 200 may be used to form lenses for base station antennas. According to embodiments of the present invention, it has been appreciated that composite dielectric materials that have non-conductive particles may be preferred over the conductive fibers suggested in the above-referenced '537 patent. For example, conductive fibers represent a potential source of passive intermodulation distortion ("PIM") in an RF communications system, and hence PIM considerations may impact the design of antennas that use composite dielectric materials that include such conductive fibers. Additionally, the response of conductive materials to radiation emitted through the antenna may depend on the size and/or shape of the conductive fibers and the frequency of the emitted radiation. As such, clustering of particles, which can effectively create particles having, for example, longer effective lengths, can potentially negatively impact the performance of the antenna. The present inventors appreciated that the use of a small amount of non-conductive high dielectric constant material dispersed in a lightweight base dielectric material could potentially provide improved performance as compared to the composite dielectric material of the '537 patent.

Moreover, because skin effect considerations are not a concern with respect to non-conductive high dielectric constant materials, using a high dielectric constant material in the form of a powder as opposed to elongated fibers becomes a possibility with the present approach. The use of such a powder may significantly simplify the manufacture of the composite dielectric material, as the high dielectric constant material powder may be thoroughly mixed into a liquefied base dielectric material and the base dielectric material may then be foamed to form a lightweight solid foamed material in which the high dielectric constant material is uniformly dispersed throughout.

Figure 3A:
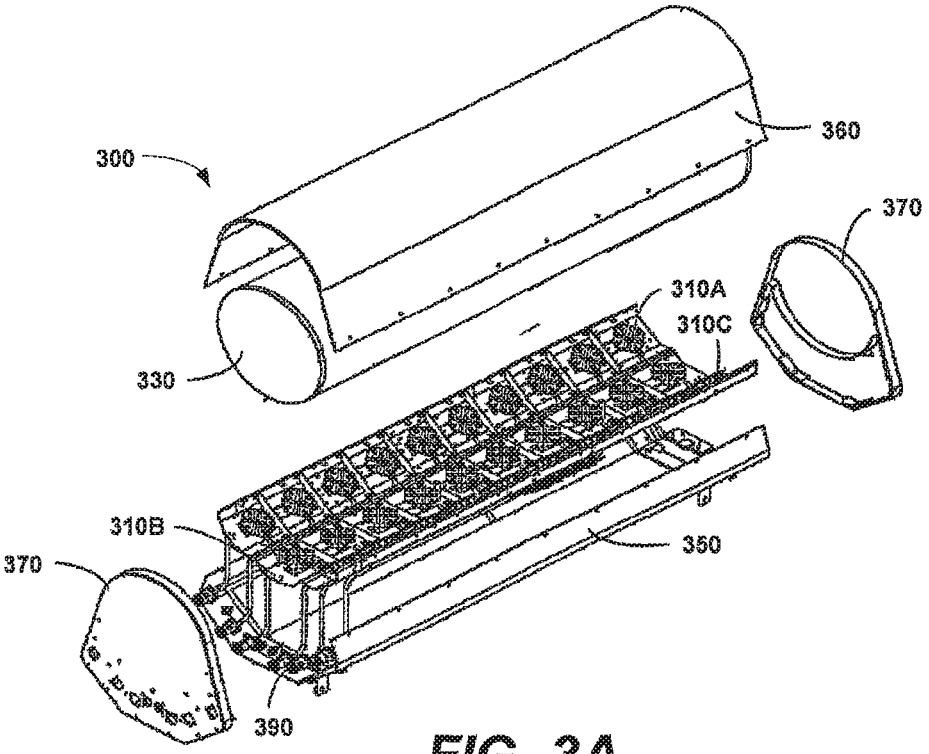
FIG. 3A is a perspective view of a lensed multi-beam antenna according to embodiments of the present invention.
Figure 3B:
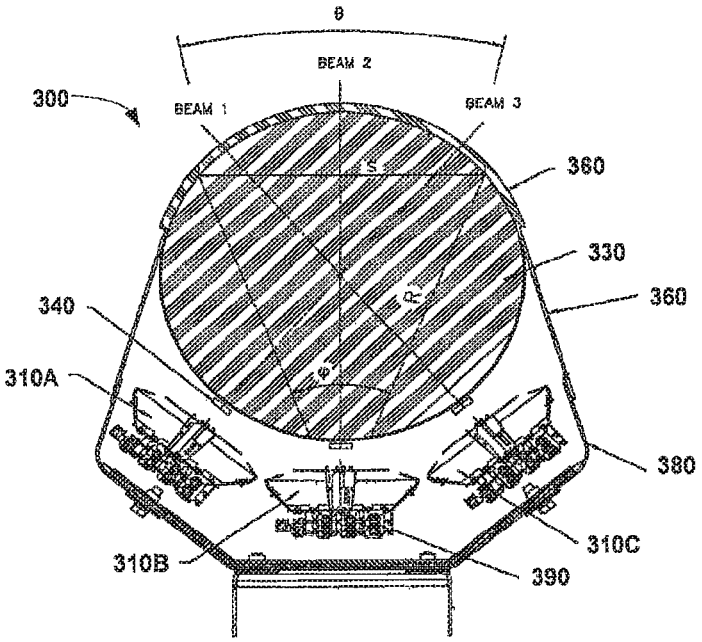
FIG. 3B is a cross-sectional view of the lensed multi-beam antenna of FIG. 3A.

FIG. 3A is a perspective view of a lensed multi-beam base station antenna 300 according to embodiments of the present invention. FIG. 3B is a cross-sectional view of the lensed multi-beam base station antenna 300.

Referring to FIGS. 3A and 3B, the multi-beam base station antenna 300 includes one or more linear arrays of radiating elements 310A, 310B, and 310C (which are referred to herein collectively using reference numeral 310). These linear arrays of radiating elements 310 are also referred to as "linear arrays" or "arrays" herein. The antenna 300 further includes an RF lens 330. In some embodiments, each linear array 310 may have approximately the same length as the lens 330. The multi-beam base station antenna 300 may also include one or more of a secondary lens 340 (see FIG. 3B), a reflector 350, a radome 360, end caps 370, a tray 380 (see FIG. 3B) and input/output ports 390. In the description that follows, the azimuth plane is perpendicular to the longitudinal axis of the RF lens 330, and the elevation plane is parallel to the longitudinal axis of the RF lens 330.

The RF lens 330 is used to focus the radiation coverage pattern or "beam" of the linear arrays 310 in the azimuth direction. For example, the RF lens 330 may shrink the 3 dB beam widths of the beams (labeled BEAM 1, BEAM 2 and BEAM 3 in FIG. 3B) output by each linear array 310 from about 65° to about 23° in the azimuth plane. While the antenna 300 includes three linear arrays 310, it will be appreciated that different numbers of linear arrays 310 may be used.

Figure 4:
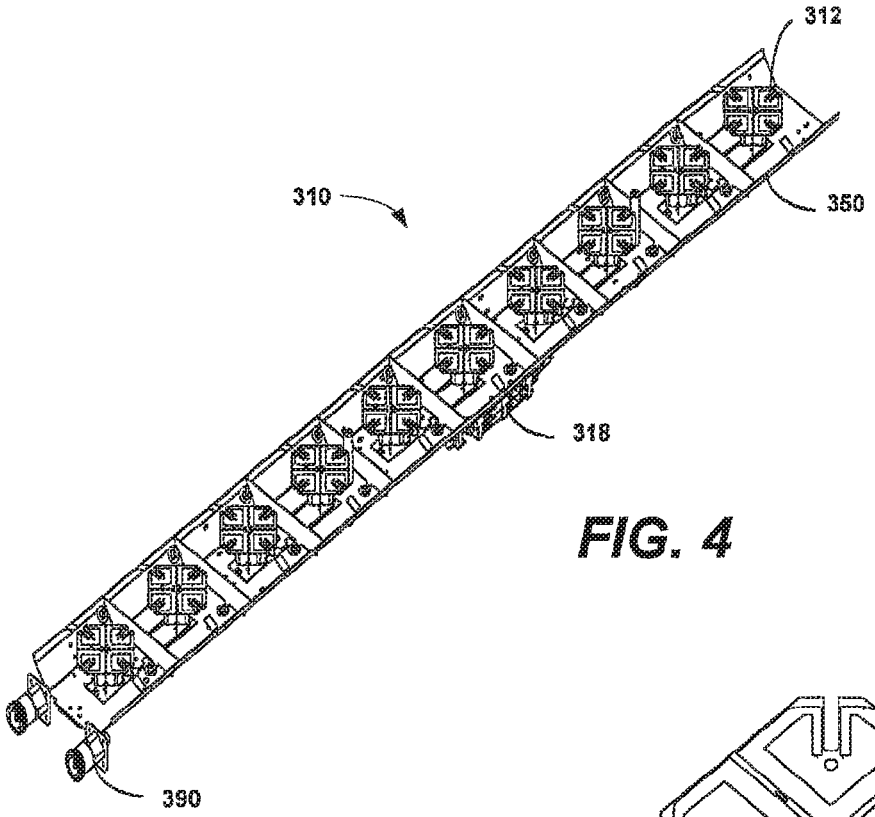
FIG. 4 is a perspective view of a linear array included in the lensed multi-beam antenna of FIG. 3A.
Figure 5A:
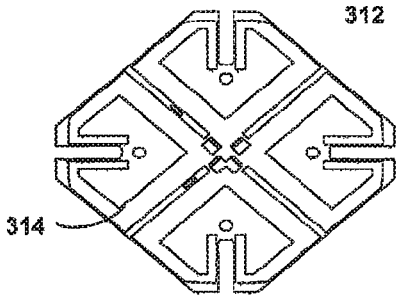
FIG. 5A is a plan view of one of the box-style dual polarized radiating elements included in the linear array of FIG. 4.
Figure 5B:
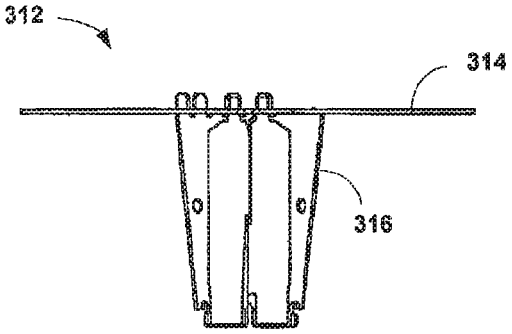
FIG. 5B is a side view of the box-style dual polarized radiating element of FIG. 5A.

Each linear array 310 includes a plurality of radiating elements 312 (see FIGS. 4, 5A and 5B). Each radiating element 312 may comprise, for example, a dipole, a patch or any other appropriate radiating element. Each radiating element 312 may be implemented as a pair of cross-polarized radiating elements, where one radiating element of the pair radiates RF energy with a +45° polarization and the other radiating element of the pair radiates RF energy with a −45° polarization.

The RF lens 330 narrows the half power beam width ("HPBW") of each of the linear arrays 310 while increasing the gain of the beam by, for example, about 4-5 dB for the 3-beam multi-beam antenna 300 depicted in FIGS. 3A and 3B. All three linear arrays 310 share the same RF lens 330, and thus each linear array 310 has its HPBW altered in the same manner. The longitudinal axes of the linear arrays 310 of radiating elements 312 can be parallel with the longitudinal axis of the lens 330. In other embodiments, the axis of the linear arrays 310 can be slightly tilted (2-10°) to the axis of the lens 330 (for example, for better return loss or port-to-port isolation tuning).

The multi-beam base station antenna 300 as described above may be used to increase system capacity. For example, a conventional 65° azimuth HPBW antenna could be replaced with the multi-beam base station antenna 300 as described above. This would increase the traffic handling capacity for the base station 100, as each beam would have 4-5 dB higher gain and hence could support higher data rates at the same quality of service. In another example, the multi-beam base station antenna 300 may be employed to reduce antenna count at a tower or other mounting location. The three beams (BEAM 1, BEAM 2, BEAM 3) generated by the antenna 300 are shown schematically in FIG. 3B. The azimuth angle for each beam may be approximately perpendicular to the reflector 350 for each of the linear arrays 310. In the depicted embodiment the −10 dB beamwidth for each of the three beams is approximately 40° and the center of each beam is pointed at azimuth angles of −40°, 0°, and 40°, respectively. Thus, the three beams together provide 120° coverage.

In some embodiments, the RF lens 330 may be formed of a dielectric material 332 that has a generally homogeneous dielectric constant throughout the lens structure. The RF lens 330 may also, in some embodiments, include a shell such as a hollow, lightweight structure that holds the dielectric material 332. This is in contrast to a conventional Luneberg lens that is formed of multiple layers of dielectric materials that have different dielectric constants. The lens 330 may be easier and less expensive to manufacture as compared to a Luneberg lens, and may also be more compact. In one embodiment, the RF lens 330 may be formed of a composite dielectric material 332 having a generally uniform dielectric constant of approximately 1.8 and diameter of about 2 wavelengths (2) of the center frequency of the signals that are to be transmitted through the radiating elements 312.

In some embodiments, the RF lens 330 may have a circular cylinder shape. In other embodiments, the RF lens 330 may comprise an elliptical cylinder, which may provide additional performance improvements (for example, reduction of the sidelobes of the central beam). Other shapes may also be used.

The RF lens 330 may be formed using any of the composite dielectric materials 100, 150, 200 that are discussed above with reference to FIGS. 1A, 1B and 2 (and the above-described variations thereof) as the composite dielectric material 332. The composite dielectric material 332 focuses the RF energy that radiates from, and is received by, the linear arrays 310.

When the cylindrical RF lens 330 is formed of a composite dielectric material 332 that has a homogeneous dielectric constant, depolarization can occur to an incident electromagnetic wave based on its geometry (nonsymmetrical for vertical (V) and horizontal (H) components of the electric field). When the electromagnetic wave crosses the cylindrical lens 330, polarization along the axis of cylinder ("the VV direction") will have a larger phase delay than polarization perpendicular to cylinder axis ("the HH direction"), causing depolarization. This depolarization can be reduced by constructing the composite dielectric material 332 to have a different dielectric constant in the VV and HH directions; specifically, the dielectric constant for the VV direction should be less than the dielectric constant for the HH direction. In other words, reduction of the naturally occurring depolarization caused by a cylindrically shaped lens 330 can be achieved using an anisotropic composite dielectric material. The difference in dielectric constant may depend on a variety of factors including the size of cylinder and the relationship between beam wavelength and the diameter of the cylinder.

The composite dielectric material 332 may be fabricated to be an anisotropic material. By mixing, or arranging, different particles with different compositions and/or shapes, different values of dielectric constant in directions parallel and perpendicular to axis of cylinder can be achieved. The composite dielectric material can be designed in some embodiments to have phase differences between the V and H components that are close to 0° to reduce or minimize antenna cross-polarization in a frequency band of interest.

FIG. 4 is, a perspective view of one of the linear arrays 310 that is included in the multi-beam base station antenna 300 of FIGS. 3A-3B. The linear array 310 includes a plurality of radiating elements 312, a reflector 350, a phase shifter/divider 318, and two input connectors 390. The phase shifter/divider 318 may be used for beam scanning (beam tilting) in the elevation plane.

Figure 5C:
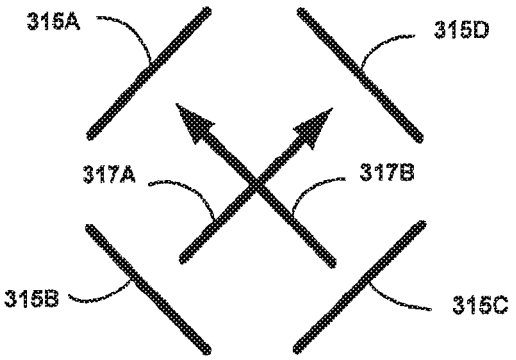
FIG. 5C is a schematic diagram illustrating the equivalent dipoles of the box-style dual polarized radiating element of FIGS. 5A-5B.

FIGS. 5A-5B illustrate the radiating elements 312 in greater detail. In particular, FIG. 5A is a plan view of one of the dual polarized radiating elements 312, and FIG. 5B is a side view of the dual polarized radiating element 312. FIG. 5C is a schematic diagram illustrating the equivalent dipoles of the dual polarized radiating element of FIGS. 5A-5B.

As shown in FIG. 5A, each radiating element 312 includes four dipoles 314 that are arranged in a square or "box" arrangement. The four dipoles 314 are supported by feed stalks 316, as illustrated in FIG. 5B. As shown in FIG. 5C, each radiating element 312 includes two linear orthogonal polarizations (slant +45°/−45°), where four equivalent dipoles 315A-315D are shown forming the two orthogonal polarization vectors 317A, 317B.

Figure 8:
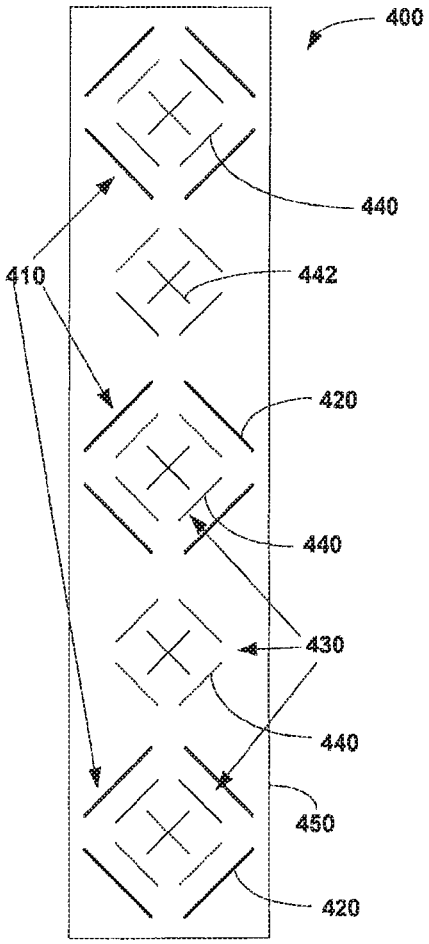
FIG. 8 is a schematic plan view of a dual band lensed multi-beam antenna according to embodiments of the present invention.

Furthermore, linear arrays can have box radiating elements that are configured to radiate in different frequency bands, interleaved with each other as shown in U.S. Pat. No. 7,405,710, which is incorporated herein by reference. In these linear arrays, a first array of box-type dipole radiating elements is coaxially disposed within a second box-type dipole assembly and located in one line. This allows a lensed antenna to operate in two frequency bands (for example, 0.79-0.96 and 1.7-2.7 GHz). For the antenna to provide similar beam widths in both frequency bands, the high band radiating elements should have directors. In this case, a low band radiating element may have, for example, a HPBW of 65-50°, and a high band radiating element may have a HPBW of 45-35°, and in the result, the lensed antenna will have stable HPBW of about 23° (and beam width about 40° by −10 dB level) across both frequency bands. FIG. 8 below provides an example of a dual-band antenna that can be used with the lenses according to embodiments of the present invention.

Figure 6A:
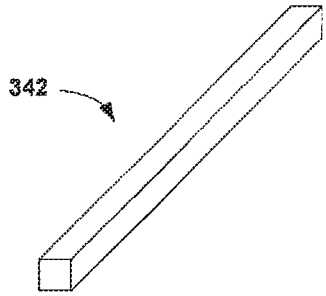
FIG. 6A is a schematic perspective view illustrating a first example of a secondary lens that may be included in the lensed multi-beam antenna of FIGS. 3A-3B.
Figure 6B:
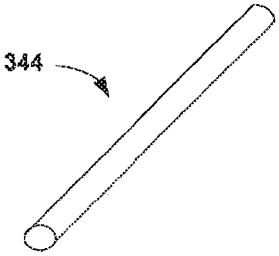
FIG. 6B is a schematic perspective view illustrating a second example of a secondary lens that may be included in the lensed multi-beam antenna of FIGS. 3A-3B.
Figure 6C:
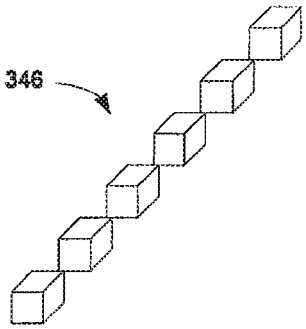
FIG. 6C is a schematic perspective view illustrating a third example of a secondary lens that may be included in the lensed multi-beam antenna of FIGS. 3A-3B.

As is further shown in FIG. 3B, the multi-beam base station antenna 300 may also include one or more secondary lenses 340. A secondary lens 340 can be placed between each linear array 310A, 310B, and 310C and the RF lens 330. The secondary lenses 340 may facilitate azimuth beamwidth stabilization. The secondary lenses 340 may be formed of dielectric materials and may be shaped as, for example, rods 342, cylinders 344 or cubes 346 as shown in FIGS. 6A-6C, respectively. Other shapes may also be used.

The use of a cylindrical lens such as lens 330 may significantly reduce grating lobes (and other far sidelobes) in the elevation plane. This reduction is due to the lens 330 focusing the main beam only and defocusing the far sidelobes. This allows increasing spacing between the antenna elements 312. In non-lensed antennas, the spacing between radiating elements in the array may be selected to control grating lobes using the criterion that $d_{max}/\lambda<1/(\sin\theta_0+1)$, where $d_{max}$ is maximum allowed spacing, λ, is the wavelength and $\theta_0$ is scan angle. In the lensed antenna 300, spacing $d_{max}$ can be increased: $d_{max}/\lambda=1.21.3[1/(\sin\theta_0+1)]$. So, the lens 330 allows the spacing between radiating elements 312 to be increased for the multi-beam base station antenna 300 while reducing the number of radiating elements by 20-30%. This results in additional cost advantages for the multi-beam base station antenna 300.

Referring again to FIGS. 3A and 3B, the radome 360, end caps 370 and tray 380 protect the antenna 300. The radome 360 and tray 380 may be formed of, for example, extruded plastic, and may be multiple parts or implemented as a single piece. In other embodiments, the tray 380 may be made from metal and may act as an additional reflector to improve the front-to-back ratio for the antenna 300. In some embodiments, an RF absorber (not shown) can be placed between the tray 380 and the linear arrays 310 for additional back lobe performance improvement. The lens 330 is spaced such that the apertures of the linear arrays 310 point at a center axis of the lens 330.

Figure 7:
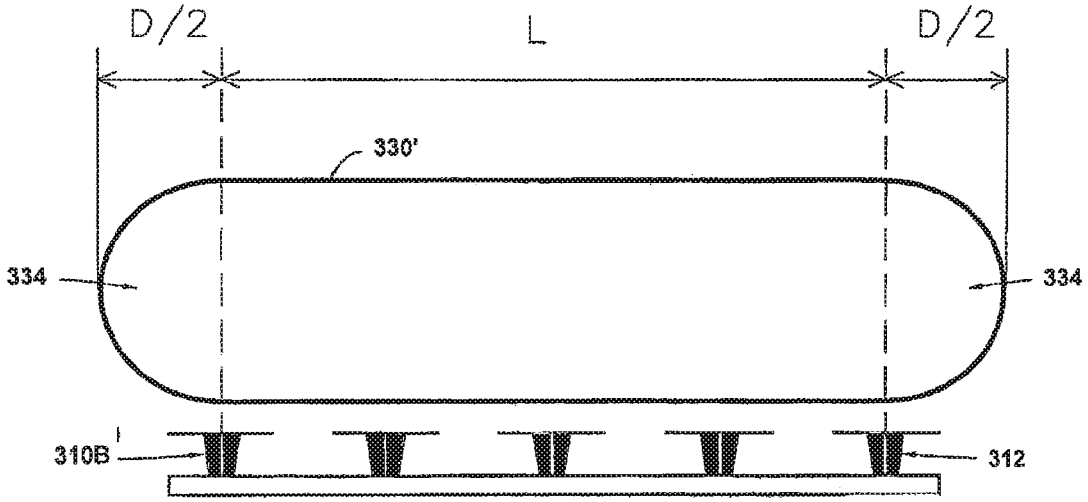
FIG. 7 is a schematic side view of a modified version of the multi-beam antenna of FIGS. 3A and 3B that uses a cylindrical lens with hemispherical end portions.

The antenna 300 of FIGS. 3A-3B has an RF lens 330 that has a flat top and a flat bottom, which may be convenient for manufacturing and/or assembly. However, it will be appreciated that in other embodiments an RF lens 330' may be used instead that has rounded (hemispherical) ends. FIG. 7 schematically illustrates such a lens 330' and its orientation with respect to the central linear array 310B of radiating elements in the antenna 300 if the lens 330 of antenna 300 was replaced with the lens 330'. The hemispherical end portions 334 included in lens 330' provide additional focusing in the elevation plane for the radiating elements 312 at the respective ends of the linear array 310B (as well as for the radiating elements 312 at the lower and upper ends of linear arrays 310A and 310C). This may improve the overall gain of the antenna.

It will likewise be appreciated that the lenses according to embodiments of the present invention may be used in dual and/or multiband base station antennas. Such antennas may include, for example antennas providing ports for transmission and reception in the 698-960 MHz frequency band as well as in the 1.7-2.7 GHz frequency band or, as another example, in both the 1.7-2.7 GHz frequency band and the 3.4-3.8 GHz frequency band. A homogeneous cylindrical RF lens works well when its diameter D=1.5-6λ (where λ is the wavelength in free space of the center frequency of the transmitted signal). Consequently, such lenses may be used with respect to the above example frequency bands as the diameter of the lens may be selected so that the lens will perform well with respect to both frequency bands. In order to provide the same azimuth beamwidth for both bands (if desired in a particular application), the azimuth beam width of the low band linear array (before passing through the RF lens) may be made to be wider than the azimuth beam width of the high band linear array, approximately in proportion to a ratio of the center frequencies of the two bands.

FIG. 8 schematically illustrates an example configuration for the radiating elements of low band and high band arrays that may be used in example dual-band multi-beam lensed antennas according to further embodiments of the present invention. The linear array 400 shown in FIG. 8 may, for example, be used in place of the linear arrays 310 in the antenna 300 of FIGS. 3A-3B.

As shown in FIG. 8, in one configuration, low band radiating elements 420 that form a first linear array 410 and high band radiating elements 440 that form a second linear array 430 may be mounted on a reflector 450. The radiating elements 420, 440 may be arranged together in a single column so that the linear arrays 410, 430 are co-linear and interspersed. In the depicted embodiments, both the low band radiating elements 420 and the high band radiating elements 440 are implemented as box-type dipole elements. In the depicted embodiment, each high band element 440 includes directors 442 which narrow the azimuth beamwidth of the high band radiating elements. For example, in one embodiment, the low band linear array 410 has an azimuth HPBW of about 65°-75° and the high band linear array 430 has an azimuth HPBW of about 40°, and the resulting HPBW of the multi-beam lensed antenna is about 23° in both frequency bands.

Figure 9A:
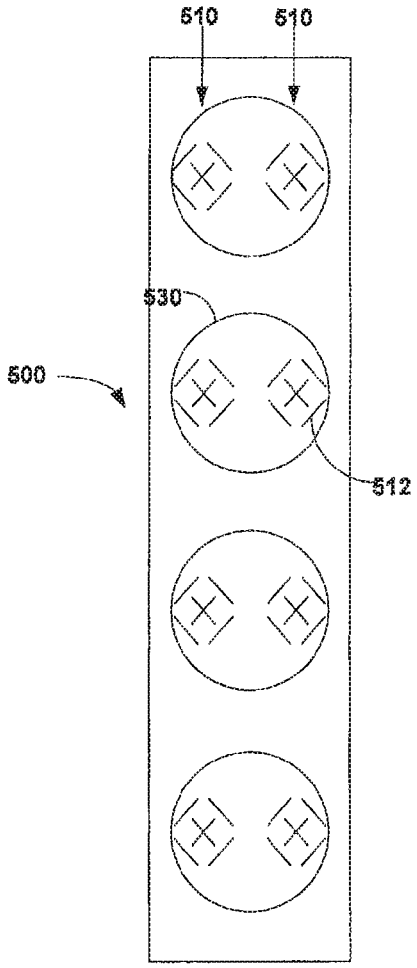
FIGS. 9A and 9B are a schematic plan view and a schematic side view, respectively, of a lensed multi-beam antenna according to further embodiments of the present invention that includes a plurality of spherical lenses.
Figure 9B:
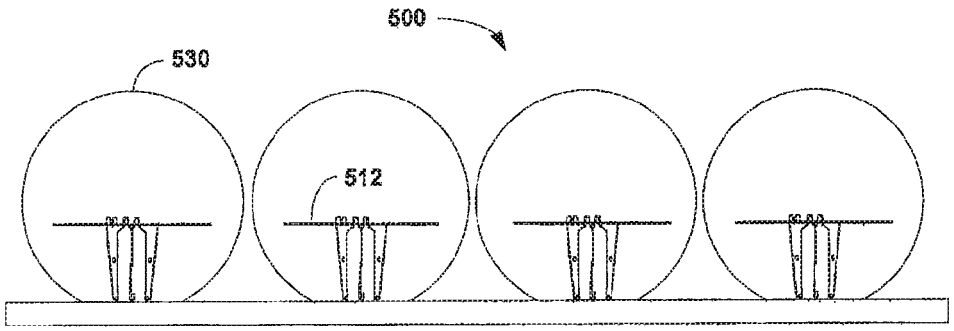

FIGS. 9A and 9B are a schematic plan view and a schematic side view, respectively, of a lensed multi-beam base station antenna 500 according to further embodiments of the present invention. As shown in FIG. 9, the multi-beam base station antenna 500 primarily differs from the multi-beam base station antenna 300 in that the cylindrical RF lens 330 of antenna 300 is replaced with a plurality of spherical lenses 530 in antenna 500.

The use of a plurality of spherical lenses 530 instead of the single cylindrical lens 330 may have several advantages in some applications. For example, in some cases, the use of spherical lenses 530 may require less dielectric material, as the dielectric material is omitted in portions of the regions between adjacent radiating elements when the spherical lenses 530 are used. This may reduce material costs for the antenna. Moreover, spherical lenses 530 generally provide more symmetrical antenna radiation patterns as compared to equivalent cylindrical lenses, and hence improved performance may be obtained. Additionally, the spherical lenses 530 may further reduce grating lobes.

As shown in FIGS. 9A and 9B, in one example embodiment, two linear arrays 510 are provided having four radiating elements 512 each, and four spherical lenses 530 are provided. The radiating elements 512 may be aligned in rows of two radiating elements 512 each. Each of the spherical lenses 530 may be positioned in front of the two radiating elements 512 in a respective one of the rows of radiating elements 512. The spherical lenses 530 may be formed in the same manner and of the same materials as the cylindrical lens 330 and hence further description thereof will be omitted.

Figure 10:
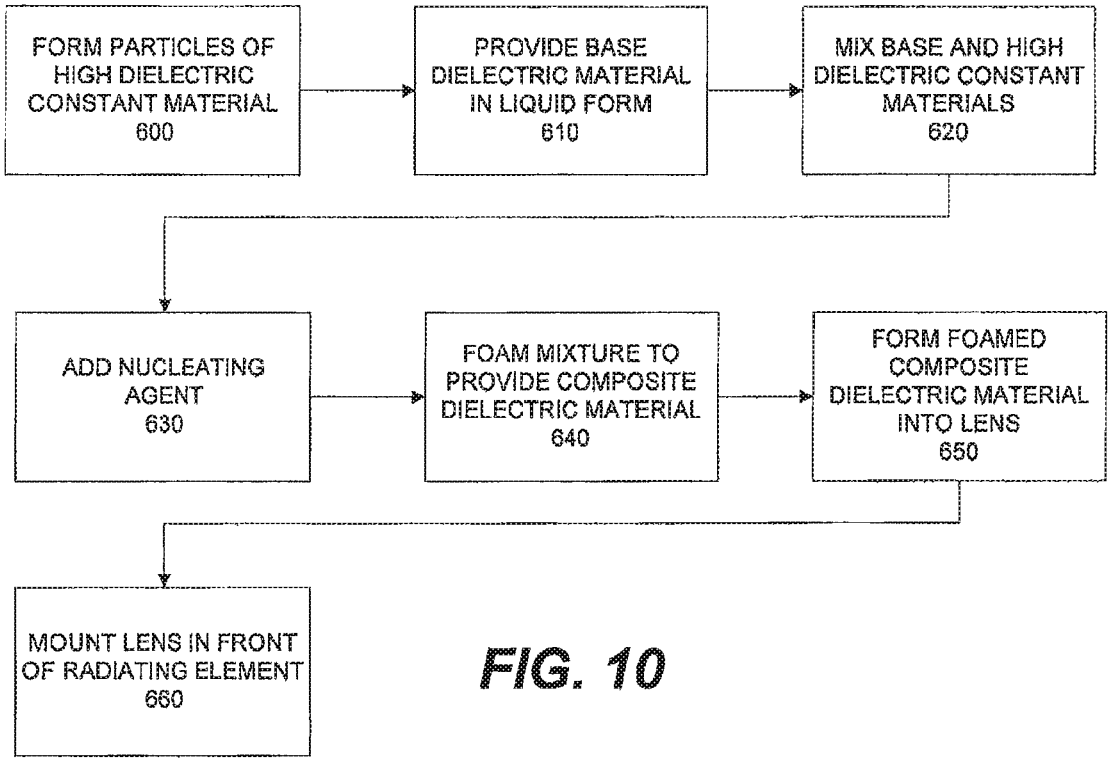
FIG. 10 is flow chart of a method of manufacturing a lensed antenna according to certain embodiments of the present invention.

FIG. 10 is flow chart of a method of manufacturing a base station antenna according to certain embodiments of the present invention. As shown in FIG. 10, a high dielectric constant material is ground into small particles (Block 600). Next, a base dielectric material such as, for example, polyethylene, polystyrene, polytetrafluoroethylene (PTEF), polypropylene, polyurethane silicon or the like is provided in liquid form (Block 610). The high dielectric constant particles are mixed into the liquid base dielectric material (Block 620). A nucleating agent such as, for example, boron nitride may be added to the liquid base dielectric material (Block 630). A blowing agent (e.g., nitrogen) is then used to foam the liquid base dielectric material with the particles of a high dielectric constant material embedded therein (Block 640) to provide a composite dielectric material. The composite dielectric material may then be used to form a lens for a multi-beam antenna (Block 650). The lens may be mounted in front of at least one radiating element of the antenna (Block 660).

Figure 11:
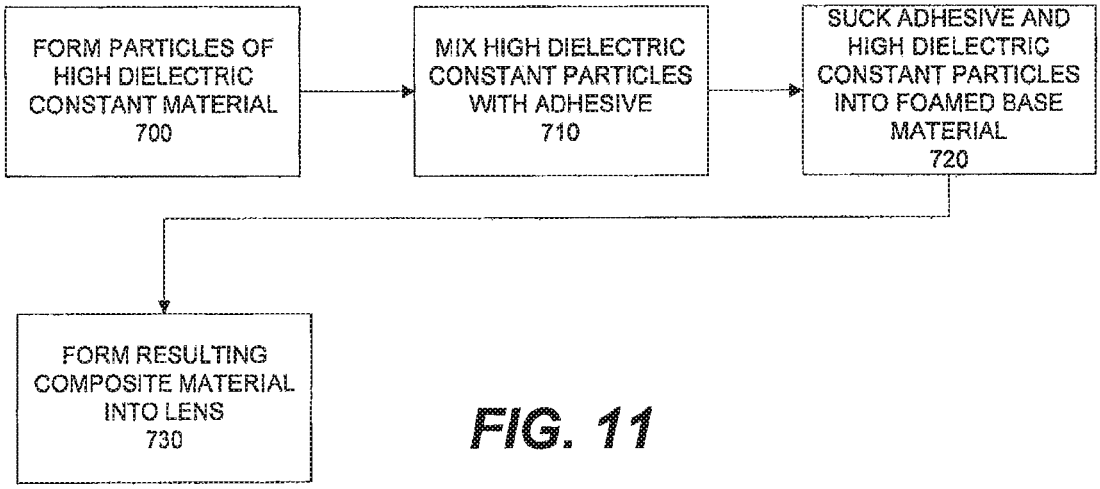
FIG. 11 is flow chart of a method of manufacturing a lensed antenna according to further embodiments of the present invention.

FIG. 11 is flow chart of a method of manufacturing a base station antenna according to further embodiments of the present invention. As shown in FIG. 11, a high dielectric constant material such as a high dielectric constant ceramic is ground into a powder or other small particles (Block 700). Next, the high dielectric constant material particles are mixed with a liquid adhesive (Block 710). The mixture of high dielectric constant material particles and adhesive is sucked into a foamed lightweight base dielectric material (Block 720). The resulting composite dielectric material may then be trimmed into an appropriate shape for use as a lens for a base station antenna (Block 730). In the fabrication technique described with respect to FIG. 11, the base dielectric material may be foamed to have an open-cell structure to facilitate drawing the high dielectric constant material particles and adhesive into the base dielectric material and uniformly distributing the high dielectric constant material particles throughout the base dielectric material.

Figure 12:
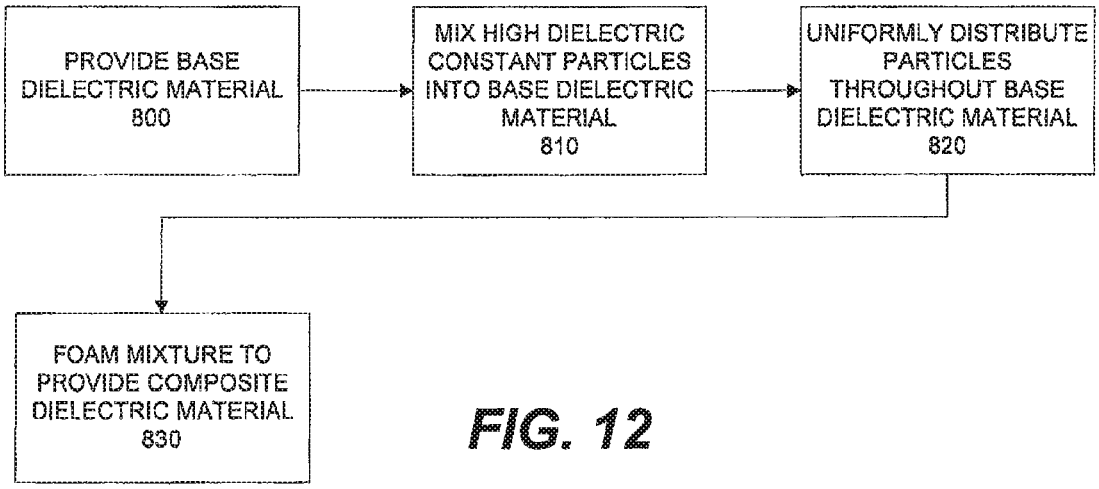
FIG. 12 is flow chart of a method of manufacturing a composite dielectric material according to embodiments of the present invention.

FIG. 12 is a flowchart illustrating a method for manufacturing a composite dielectric material for a lens of a multi-beam antenna according to further embodiments of the present invention. A base dielectric material that is capable of foaming is provided (Block 800). A high dielectric constant material such as, for example, a ceramic material having a dielectric constant of at least ten is mixed into the base dielectric material while the base dielectric material is in a liquid or semi-liquid form (Block 810). The high dielectric constant material may be in the form of a powder or other small particles such as elongated particles. The liquid base dielectric material with the particles of high dielectric constant material therein is thoroughly mixed to uniformly distribute the particles of high dielectric constant material throughout the base dielectric material (Block 820). The composite dielectric material may then be foamed to provide a lightweight dielectric constant material that is suitable for use in forming a lens of a multi-beam antenna (Block 830).

It will be appreciated that numerous modifications may be made to the above-described embodiments without departing from the scope of the present invention. For example, with respect to the lightweight composite dielectric materials that are described above that are formed as small blocks that are used to build the lens, it will be understood that different high dielectric constant materials may be used for different blocks and/or within the same blocks. Likewise, different blocks may include different lightweight base dielectric materials.

While embodiments of the present invention are primarily discussed above with respect to non-conductive particles of a high dielectric constant dielectric material, it will be appreciated that in other embodiments high dielectric constant dielectric materials that have some amount of conductivity may be used.

While the foregoing examples are described with respect to three beam antennas, additional embodiments including, for example, antennas having 2, 4, 5, 6 or more beams are also contemplated. It will also be appreciated that the lens may be used narrow at least the azimuth beam of a base station antenna from a first value to a second value. The first value may comprise, for example, about 90°, 65° or a wide variety of other azimuth beamwidths. The second value may comprise about 65°, 45°, 33°, 25°, etc. It will also be appreciated that in multi-band antennas according to embodiments of the present invention the degree of narrowing can be the same or different for the linear arrays of different frequency bands.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A multi-beam antenna, comprising:

a plurality of radiating elements; and a lens that is positioned to receive electromagnetic radiation from at least one of the radiating elements, the lens comprising a composite dielectric material, wherein the composite dielectric material comprises a foamed base dielectric material having particles of a high dielectric constant material embedded therein, the high dielectric constant material having a dielectric constant that is at least three times a dielectric constant of the foamed base dielectric material, wherein the high dielectric constant material comprises a ceramic material or a metal oxide.

2. The multi-beam antenna of claim 1, wherein the high dielectric constant material has a dielectric constant of at least 10.

3. The multi-beam antenna of claim 1, wherein the foamed dielectric material comprises a foamed plastic.

4. The multi-beam antenna of claim 1, wherein the foamed dielectric material has a foaming percentage of at least 50%.

5. The multi-beam antenna of claim 1, wherein the high dielectric constant material is substantially uniformly distributed throughout the foamed dielectric material.

6. The multi-beam antenna of claim 1, wherein the lens comprises a cylindrical lens.

7. The multi-beam antenna of claim 1, wherein the lens comprises at least one spherical lens.

8. The multi-beam antenna of claim 1, wherein the high dielectric constant material comprises a powder.

9. The multi-beam antenna of claim 1, wherein the composite dielectric material comprises a plurality of blocks.

10. The multi-beam antenna of claim 9, wherein the high dielectric constant material is only embedded into the exterior surfaces of the blocks.

11. A multi-beam antenna, comprising:

a plurality of radiating elements; and a lens that is positioned to receive electromagnetic radiation from at least one of the radiating elements, the lens comprising a plurality of blocks that are contained within an outer shell of a composite dielectric material, wherein each block comprises a composite dielectric material that includes a base dielectric material having particles of a high dielectric constant material embedded therein, the high dielectric constant material having a dielectric constant that is at least three times a dielectric constant of the base dielectric material.

12. The multi-beam antenna of claim 11, wherein the high dielectric constant material has a dielectric constant of at least 10.

13. The multi-beam antenna of claim 11, wherein the base dielectric material comprises a foamed dielectric material and the high dielectric constant material comprises a ceramic material or a metal oxide.

14. The multi-beam antenna of claim 13, wherein the foamed dielectric material has an open-cell structure and a foaming percentage of at least 50%.

15. The multi-beam antenna of claim 11, wherein the high dielectric constant material is substantially uniformly distributed throughout the foamed dielectric material.

16. The multi-beam antenna of claim 11, wherein the lens comprises one of a cylindrical lens or a spherical lens.

17. A method of fabricating a multi-beam antenna, the method comprising:

mixing particles of a second dielectric material into a first dielectric material that is in liquid form, the second dielectric material having a dielectric constant that is at least three times a dielectric constant of the first dielectric material;

adding a nucleating agent to the first dielectric material;

using a blowing agent to foam the first dielectric material having the particles of the second dielectric material mixed therein;

using the foamed first dielectric material for a lens for the multi-beam antenna; and mounting the lens in front of at least one radiating element.

18. The method of claim 17, wherein the second dielectric material is substantially uniformly distributed throughout the first dielectric material.

* * * * *